US008167447B2

(12) United States Patent
Yuan

(10) Patent No.: US 8,167,447 B2
(45) Date of Patent: May 1, 2012

(54) ADJUSTABLE DESK LAMP

(75) Inventor: Hui Yuan, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 295 days.

(21) Appl. No.: 12/606,118

(22) Filed: Oct. 26, 2009

(65) Prior Publication Data

US 2011/0069504 A1 Mar. 24, 2011

(30) Foreign Application Priority Data

Sep. 21, 2009 (CN) ..... 2009 1 0307354

(51) Int. Cl.
*F21V 33/00* (2006.01)
*F21V 19/02* (2006.01)

(52) U.S. Cl. ..... 362/101; 362/285; 362/413; 362/414; 362/418; 362/431

(58) Field of Classification Search ..... 362/101, 362/285, 318, 410, 413, 414, 431
See application file for complete search history.

(56) References Cited

U.S. PATENT DOCUMENTS 6,467,936 B1 * 10/2002 Golemba ..... 362/413
7,019,464 B2 * 3/2006 Nevins ..... 315/149
2010/0296279 A1 * 11/2010 Ko ..... 362/231

* cited by examiner

*Primary Examiner* — Stephen F Husar
*Assistant Examiner* — James Cranson, Jr.
(74) *Attorney, Agent, or Firm* — Altis Law Group, Inc.

(57) ABSTRACT

An adjustable desk lamp includes at least two buttons, a lamp panel, a stand, and a support arm assembly. The stand includes at least two button housings. Each of the button housings is filled with liquid and receives one of the buttons. The arm assembly is attached to the stand. The arm assembly includes at least two channels and at least two support posts. Each of the channels communicates with one of the button housings and is filled with liquid. One end of each of the posts is received in one of the channels, and another end support the lamp pane. When one of the buttons is operated, the liquid in the button hole receiving the operated button and the channel communicating with the button hole is displaced, and the post received in the channel moves downwardly or upwardly, thus the lamp panel can cast light at a different angle.

7 Claims, 6 Drawing Sheets

ADJUSTABLE DESK LAMP

BACKGROUND

1. Technical Field

The present disclosure relates to desk lamps and, particularly, to an adjustable desk lamp.

2. Description of Related Art

A conventional desk lamp is composed of a stand, a deformable support arm attached to the stand, and a lamp panel supported by the support arm. Users usually adjust the deformable support arm to adjust position and orientation of the lamp panel. However, the deformable arm easily gets loose after repeated uses, thus, the desk lamp might not be able to hold a position or orientation firmly any more.

BRIEF DESCRIPTION OF THE DRAWINGS

The components of the drawings are not necessarily drawn to scale, the emphasis instead being placed upon clearly illustrating the principles of an adjustable desk lamp. Moreover, in the drawings, like reference numerals designate corresponding parts throughout several views.

DETAILED DESCRIPTION

Figure 1:
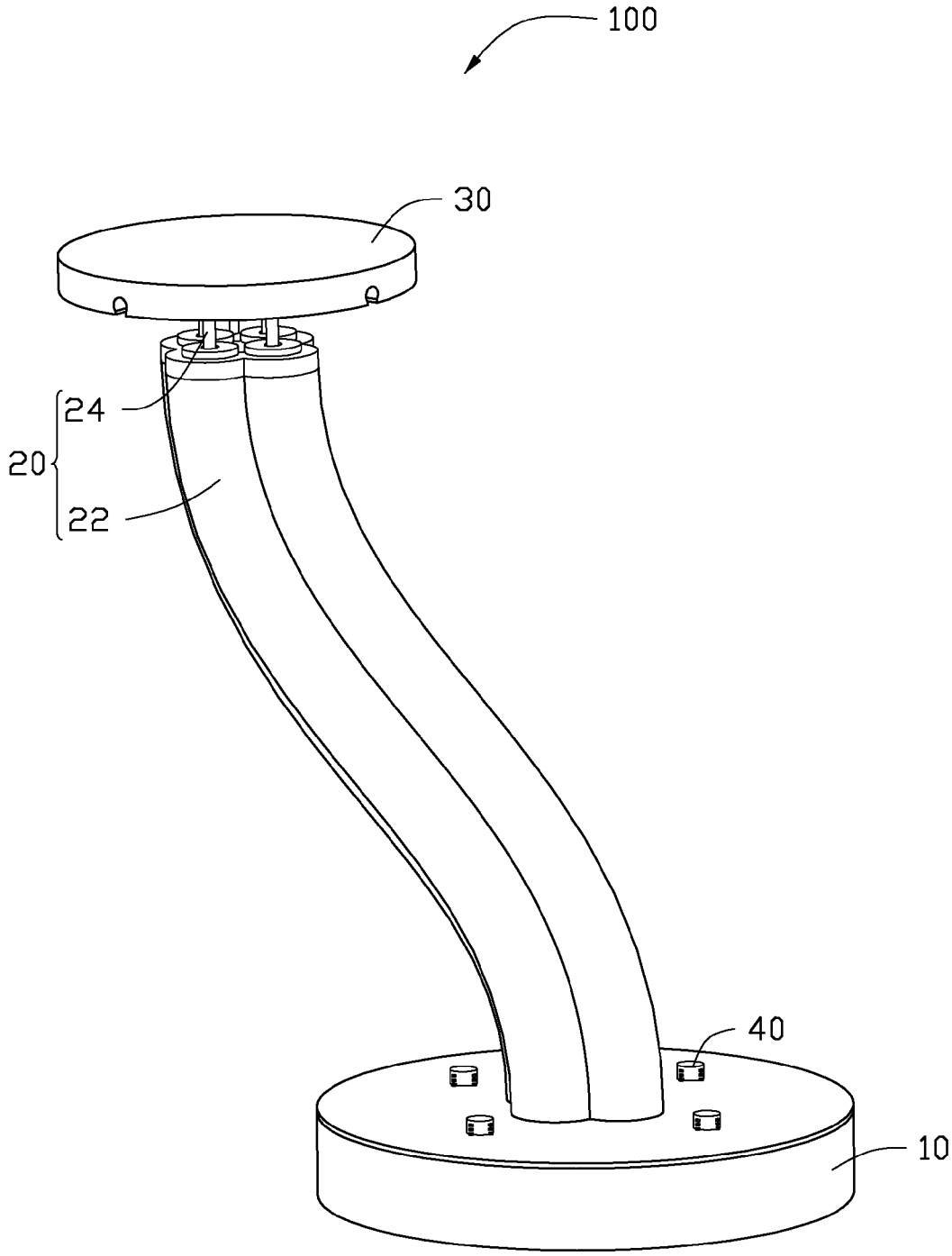
FIG. 1 is an isometric view of the adjustable desk lamp in accordance with an exemplary embodiment.

Referring to FIG. 1, an embodiment of an adjustable desk lamp 100 is illustrated. The lamp 100 includes a stand 10, a support arm assembly 20, and a lamp panel 30. The support arm assembly 20 is attached to the stand 10 and supports the lamp panel 30. The support arm assembly 20 includes at least two first support posts 22 and at least two corresponding second support posts 24. The first support posts 22 are attached to the stand 10, and the second support posts 24 support the lamp panel 30. The stand 10 and the first support posts 22 are filled with liquid. At least two buttons 40 are mounted on the stand 10. The downward movement or the upward movement of any of the buttons 40 displaces the liquid within the stand 10 and the first support posts 22. The displacement of the liquid can move the second support posts 22 upwards or downwards. The movement of the second support posts 22 adjusts the orientation of the lamp panel 30, thus the lamp panel 30 can cast light at predetermined angles. In the exemplary embodiment, there are four buttons 40, four first support posts 22, and four second support posts 24.

Figure 2:
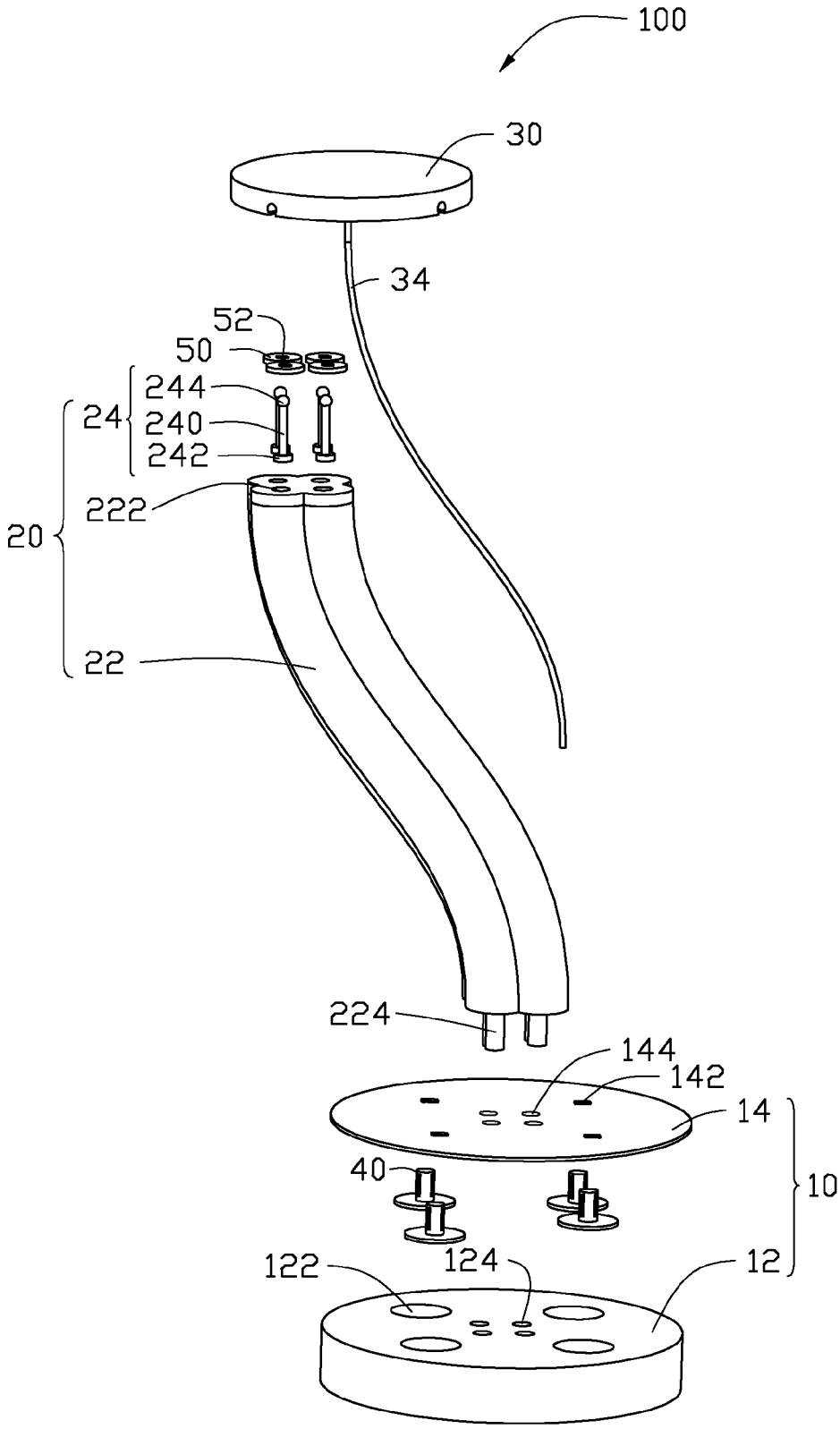
FIG. 2 is an exploded, perspective view of the adjustable desk lamp of FIG. 1.
Figure 3:
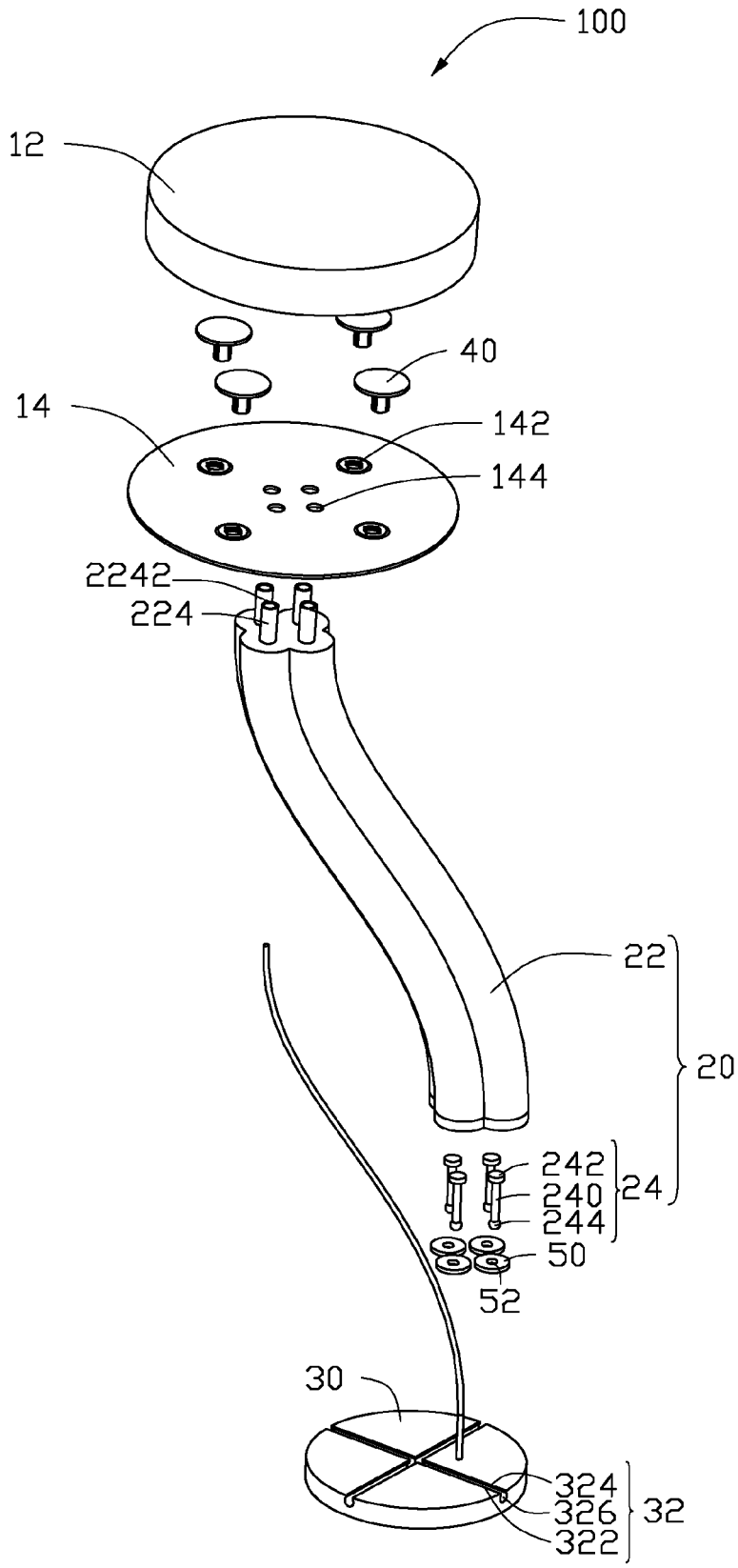
FIG. 3 is another exploded, perspective view of the adjustable desk lamp of FIG. 1, showing different perspective.
Figure 4:
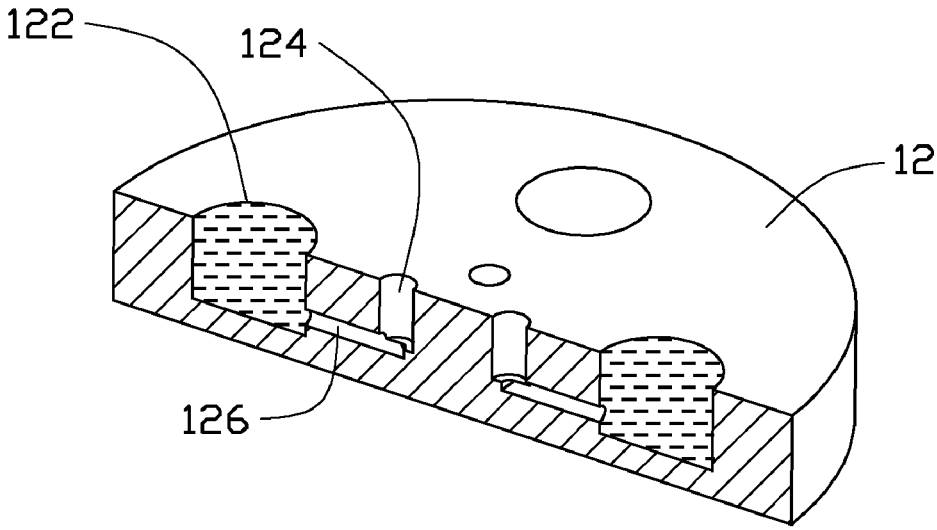
FIG. 4 is a cutaway view of a stand of the adjustable desk lamp of FIG. 2.

Referring also to FIGS. 2-4, in the exemplary embodiment, the stand 10 is substantially a disc. The stand 10 includes a base 12 and a cover 14. The base 12 defines four first button housings 122 and four first guide holes 124. The first guide holes 124 are defined at a distance further away from the sidewall of the base 12 than the first button housings 122. The base 12 also defines four guide channels 126, and each of the guide channels 126 communicates with one of the first button housings 122 and one of the first guide holes 124.

Figure 5:
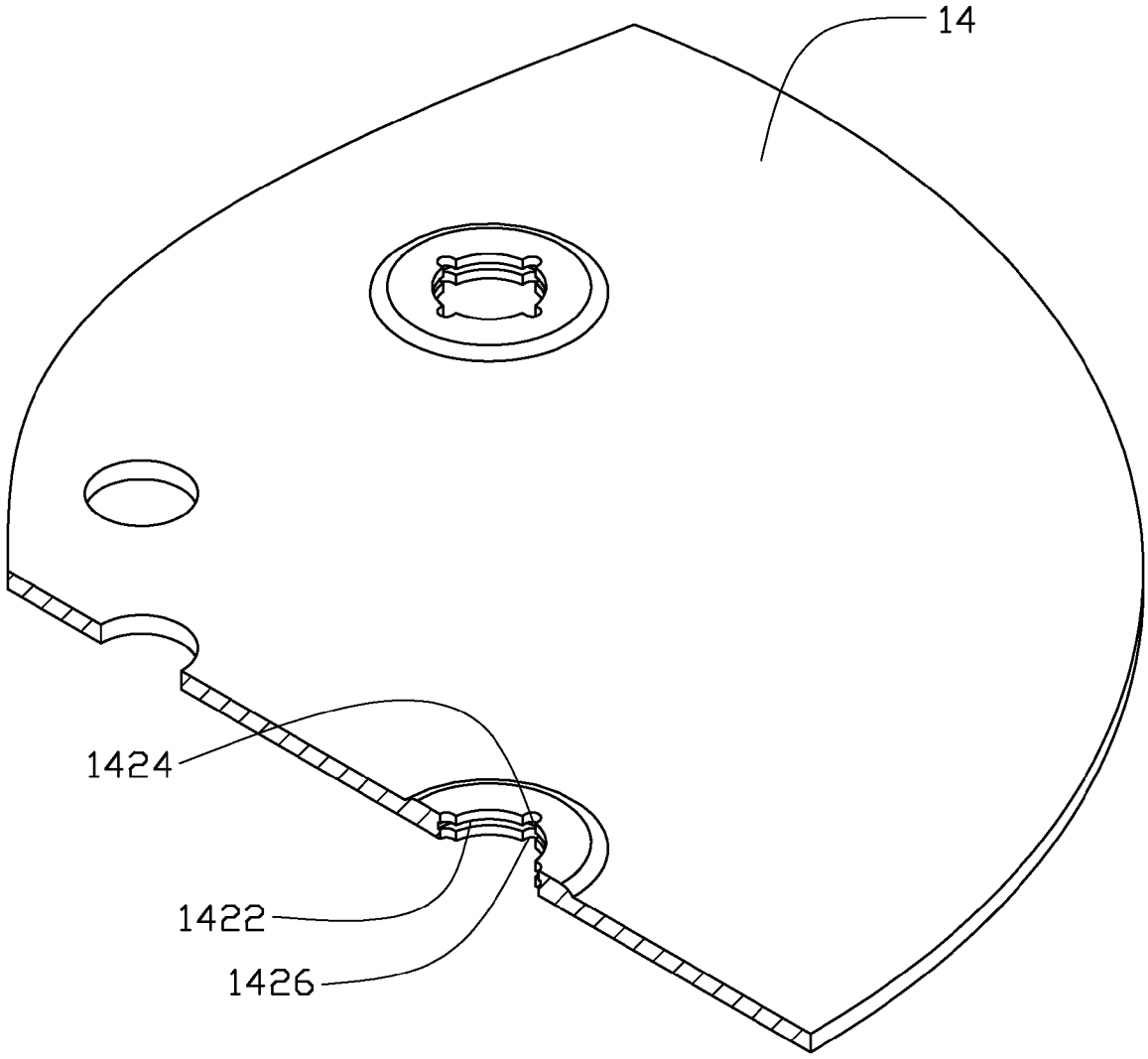
FIG. 5 is a partial, cutaway view of a cover of the adjustable desk lamp of FIG. 2.

Referring also to FIG. 5, the cover 14 defines four second button housings 142 and four second guide holes 144. Each of the second button housings 142 is aligned with one of the first button housings 122. Each of the second guide holes 144 is aligned with one of the first guide holes 124. The second button housings 142 have radiuses shorter than that of the first button housings 122 correspondingly. The sidewall of each of the second button housings 142 defines an annular groove 1422, at least one first recessed receiving portion 1424, and at least one second recessed receiving portion 1426. Each of the first receiving portions 1424 extends away from the top of the cover 14, and communicates with the groove 1422. Each of the second receiving portions 1426 extends away from the bottom of the cover 14, and communicates with the groove 1422. Each of the first receiving portions 1424 is aligned with one of the second receiving portions 1426. The depth of each of the first receiving portion 1424 substantially equals to that of each of the second receiving portion 1426.

Figure 6:
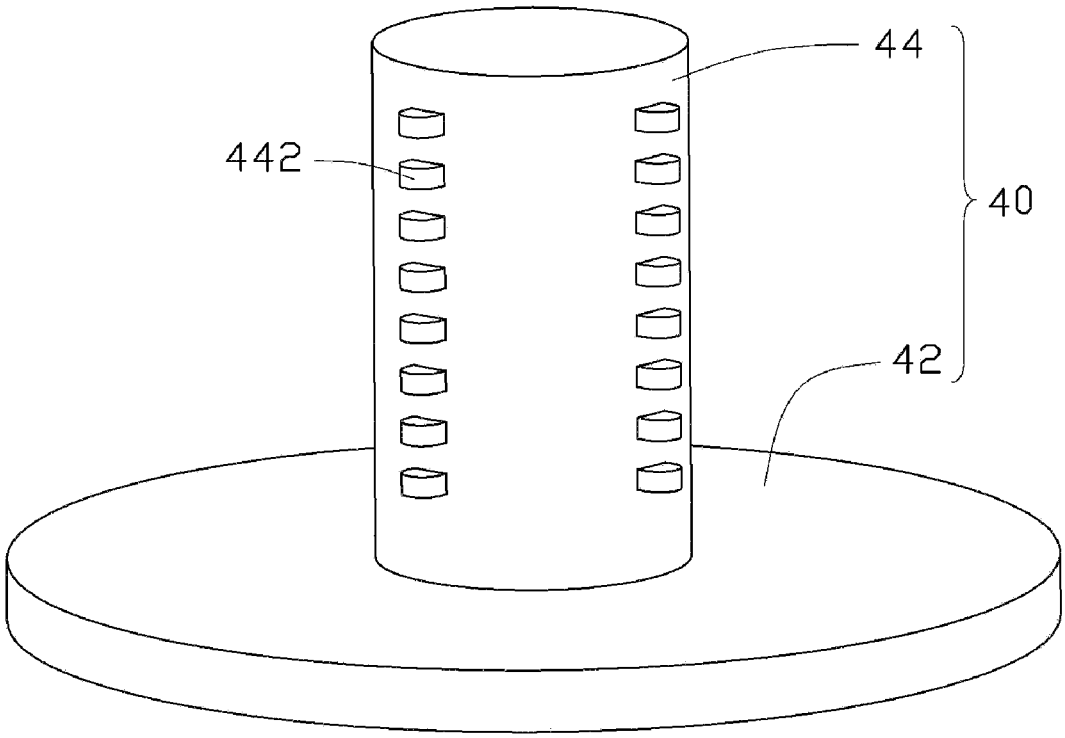
FIG. 6 is an enlarged, isometric view of a button of the adjustable desk lamp of FIG. 2.

Referring also to FIG. 6, each of the buttons 40 includes a pressing panel 42 and a pressing post 44 attached to the pressing panel 42. The radius of each of the pressing panels 42 substantially equals to that of each of the first button housings 122, and the radius of each of the pressing posts 44 substantially equals to that of each of the second button housings 142. At least one column of projections 442 protrudes out from the sidewall of each of the pressing posts 44 and extends along the axis of each of the pressing posts 44. Each of the projections 442 can be received in the first receiving portion 1424 and the second receiving portion 1426. The height of each of the projections 442 is slightly less than that the depth of the groove 1422. The distance between adjacent projections 442 in one column of the projections 442 is substantially the same, and is slightly greater than the depth of the first receiving portion 1424 or the second receiving portion 1426. Therefore, when one of the projections 442 in one column is received in the groove 1422, the adjacent projections 142 in the column are not received in the second button housings 142, and the buttons 40 can be rotated.

The following description is for illustrating the process of assembling the stand 10. The assembly procedure mainly includes the following steps: inserting each of the pressing panels 42 into the first button housings 122 of the base 12 correspondingly; passing each of the pressing posts 44 through the second button housings 142 of the cover 14 by aligning the projections 442 with the first receiving portions 1424 or the second receiving portions 1426 correspondingly; attaching the cover 14 to the base 12 using adhesive material. After the stand 10 is assembled, the buttons 40 can be pulled or pressed. When any of the buttons 40 is pulled or pressed until at least one of the projections 442 is positioned between the first receiving portion 1424 and the second receiving portion 1426, the button 40 can be rotated to slide the projection 442 into the groove 1422. The height of the projection 442 is slightly less than the depth of the groove 1422, thus when the projection 442 is received in the groove 1422, the button 40 can not be pulled or pressed due to the limit of the groove 1422.

Each of the first support posts 22 defines a first channel 222. The first channel 222 extends along the axis of each of the first support posts 22. A guide post 224 protrudes from the bottom of each of the support posts 22. The radius of each of the guide posts 224 substantially equals to that of the first guide holes 124. Each of the guide posts 224 defines a second channel 2242. Each of the second channels 2242 extends along the axis of the guide posts 224. Each of the first channels 222 communicates with one of the second channels 2242. Each of the second support posts 24 includes a main body 240, a pressing end 242, and a linking end 244. Each of the pressing ends 242 is received in one of the first channels 222. The linking ends 244 support the lamp panel 30. The radius of each of the pressing ends 242 is greater than that of the main body 240, and substantially equals to that of the first channels 222. Each of the linking ends 244 is substantially spherical.

In the exemplary embodiment, the lamp 100 further includes four rings 50. Each of the rings 50 defines a through hole 52. The radius of each of the through holes 52 is greater than that of the linking ends 244, and less than that of the pressing ends 242.

The back of the lamp panel 30 defines four sliding slots 32. Each of the sliding slots 32 extends along the radius of the lamp panel 30. Each of the sliding slots 32 includes two brinks 322 and 324, and an opening 326. The opening 326 is formed on the sidewall of the lamp panel 30. The distance between the brinks 322 and 324 is slightly greater than the radius of the main bodies 240 of the second support posts 24, and is less than the radius of the linking ends 244 of the second support posts 24. A conductive panel (not shown) of the lamp panel 30 is electrically connected to a wire 34, and the wire 34 is electrically connected to a power source (not shown).

The following description is for illustrating the process of assembling the lamp 100. The assembly procedure mainly includes the following steps: inserting each of the guide posts 224 into the second guide holes 144 and the first guide holes 124; attaching the support posts 22 to the stand 10 using adhesive material; pouring the liquid into the first channels 222 of the first support posts 22, the second channels 2242 of the guide posts 224, and the first button housings 122; placing each of the rings 50 over the main bodies 240 of the second support posts 24 via inserting each of the linking ends 244 through the through holes 52 of the rings 50; sliding each of the linking ends 244 of the second posts 24 into the sliding slots 32 from the openings 326; inserting each of the pressing ends 242 of the second support posts 24 into the first channel 222; and attaching the rings 50 to the top of the first support posts 22 using adhesive material. The radius of each of the pressing ends 242 is greater than that of the through holes 52 of the rings 50, thus the pressing ends 242 cannot slide out from the first channels 222 of the first support posts 22.

Before one of the buttons 40 is pressed or pulled, the buttons 40 are rotated till the projections 442 align with the first receiving portions 1424 and the second receiving portions 1426. After one of the buttons 40 is pressed or pulled, the liquid in the first button hole 122 receiving the button 40, the guide channel 126 communicating with the first button hole 122, the second channel 2242 communicating with the guide channel 126, and the first channel 222 communicating with the second channel 2242 is displaced, thus the second support post 24 received in the first channel 222 moves upwardly or downwardly due to the displacement of the liquid. When the second support post 24 moves upwardly, the lamp panel 30 inclines toward a first direction. When the second support post 24 moves downwardly, the lamp panel 30 inclines toward a second direction opposite to the first direction. When the lamp panel 30 inclines toward the first direction or the second direction, another second support post 24 moves downwardly or upwardly due to the incline of the lamp panel 30. After the incline angle of the lamp panel 30 reaches a desired angle, the buttons 40 are rotated to slide a projection 442 in one column into the groove 1422.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An adjustable desk lamp, comprising:

at least two buttons;

a lamp panel;

a stand comprising at least two first button housings and at least two first guide holes, wherein each of the first button housings communicates with one of the first guide holes; each of the first button housings receives one of the buttons; and each of the first button housings is filled with liquid; and a support arm assembly attached to the stand and supporting the lamp panel, wherein the support arm assembly comprises at least two channels and at least two support posts, each of the channels communicates with one of the first guide holes and is filled with liquid; one end of each of the support posts is received in one of the channels, and another end of each of the support posts supports the lamp panel;

wherein when one of the buttons is pulled or pressed, the liquid in the button hole receiving the pulled or pressed button and the channel communicating with the button hole is displaced, and the support post received in the channel moves downwardly or upwardly due to the displacement of the liquid, thus the lamp panel casts light at a different angle due to the movement of the support post.

2. The adjustable desk lamp as described in claim 1, wherein the stand comprises a base defining the first button housings and the first guide holes.

3. The adjustable desk lamp as described in claim 2, wherein the stand further comprises a cover defining at least two second button housings, each of the second button housings is aligned with one of the first button housings; each of the buttons comprises a pressing panel and a pressing post, each of the pressing panels is received in one of the first button housings, and each of the pressing posts is received in one of the second button housings.

4. The adjustable desk lamp as described in claim 3, wherein the sidewall of each of the second button housings defines an annular groove, at least one first recessed receiving portion, and at least one second receiving portion aligned with the at least one first receiving portion; the at least one first recessed receiving portion extends away from the top of the each of the second button housings and communicates with the groove, the at least one two recessed receiving portion extends away from the bottom of each of the second button housings and communicates with the groove; at least one column of projections protrudes out from the sidewall of each of the pressing posts of the buttons, each of the projections can be received in the at least one first recessed receiving portion and the at least one second recessed receiving portion, and can slide along the groove.

5. The adjustable desk lamp as described in claim 4, wherein the depth of the at least one first recessed receiving portion equal to that of the at least one second recessed receiving portion; the height of each of the projections is equal to the depth of the groove; and the distance between adjacent projections in one column equals, and is further greater than the depth of the at least one first recessed receiving portion.

6. The adjustable desk lamp as described in claim 1, wherein the back of the lamp panel defines at least two sliding slots; and the end of each of the support posts supporting the lamp panel can slide into one of the sliding slots.

7. The adjustable desk lamp as described in claim 6, wherein each of the support posts comprises a main body, the end of each of the support posts supporting the lamp panel is spherical; each of the sliding slots extends along the radius of the lamp panel, and each of the sliding slots comprises two brinks and an opening formed on the sidewall of the lamp panel, the distance between two brinks of each of the sliding slots is less than the radius of the end of each of the support posts supporting the lamp panel and greater than the radius of each of the main bodies of each of the support posts.

* * * * *